US005700323A

United States Patent [19]

Koch et al.

[11] Patent Number: 5,700,323

[45] Date of Patent: Dec. 23, 1997

[54] ANTI-CONTAMINATION VALVE FOR POWDER DELIVERY SYSTEM

[75] Inventors: Dean Koch, Amherst; Jeff Shutic, Wakeman, both of Ohio

[73] Assignee: Nordson Corporation, Westlake, Ohio

[21] Appl. No.: 553,970

[22] Filed: Nov. 6, 1995

[51] Int. Cl.[6] ..... B05C 19/00

[52] U.S. Cl. ..... 118/308; 118/308; 118/326

[58] Field of Search ..... 118/308, 309, 118/310, 313, 326; 141/346, 347, 348, 360, 362; 222/153.05, 153.13, 153.14, 153.01; 137/383, 384; 239/395, 583, 569; 251/173, 298, 305, 306

[56] References Cited

U.S. PATENT DOCUMENTS

| | | | |
|---|---|---|---|
| 4,254,936 | 3/1981 | Schuurman | 251/173 |
| 4,710,286 | 12/1987 | Mulder | 209/250 |
| 4,836,499 | 6/1989 | Steele et al. | 251/173 |

OTHER PUBLICATIONS

NLB Corp. Advertisement for "Posi-Flate" Butterfly Valves, PROCESSING Magazine, Aug. 1995.

*Primary Examiner*—Donald E. Czaja
*Assistant Examiner*—Calvin Padgett
*Attorney, Agent, or Firm*—Holland & Knight LLP

[57] ABSTRACT

A method and apparatus for isolating a portion of a powder delivery system from contamination includes an anti-contamination valve interposed between the discharge outlet of a sieve in the powder delivery system and the inlet to a powder feeder device communicating with one or more spray guns associated with a powder spray booth. The valve is movable between an open position in which powder discharged from the sieve is permitted to flow unobstructed to the powder feeder device, and a closed position which effectively seals or isolates that portion of the powder delivery system downstream from the sieve.

6 Claims, 5 Drawing Sheets

ANTI-CONTAMINATION VALVE FOR POWDER DELIVERY SYSTEM

FIELD OF THE INVENTION

This invention relates to powder coating delivery systems, and, more particularly, to an anti-contamination valve interposed between the sieve and downstream powder transfer devices which communicate with one or more spray guns associated with a powder spray booth so that the sieve can undergo maintenance without contaminating the powder coating material downstream.

BACKGROUND OF THE INVENTION

Particulate powder coating materials are commonly used to coat or paint objects in industrial finishing applications. In these applications, a particulate powder material such as epoxy, polyester or porcelain frit is conveyed to a powder spray gun while entrained in an airstream and is sprayed from the nozzle of the gun onto a target surface or substrate. An electrostatic charge is imparted to the powder coating material, and the target is held at a different or ground potential, so that powder loosely adheres thereto for subsequent melting in an oven to form a permanent coating.

In most applications, powder deposition is performed in a booth within which the powder spray guns are mounted. Articles are moved through the booth on a conveyor and coated with a particulate powder material supplied to the applicator guns by a source of air entrained powder. Oversprayed powder is contained within the booth by an exhaust system and collected in one or more powder recovery units where it is either held or recirculated back to the applicator guns, generally via a powder feed hopper.

One problem which is of particular concern, particularly when high quality finishes are desired such as in automotive coating operations, is maintaining the virgin and recovered powder coating material free of contamination as it is transferred through the application system. Conventionally, virgin powder coating material is withdrawn from a supply hopper or conveyor into a rotary or vibratory sieve, with or without an intermediate receiver unit interposed therebetween. The purpose of the sieve is to remove debris, contaminants, and overly large powder particles as the powder material passes therethrough. Upon exiting the sieve, the powder coating material may be pumped directly to one or more spray guns associated with the powder spray booth, or, alternatively, the powder coating material is temporarily stored in one or more feed hoppers which supply the spray guns. In either case, it is desirable to maintain the powder coating material free from contamination throughout its transfer the supply hopper to the spray guns and back through the recovery system.

In the normal course of a powder coating operation, the sieves employed in the powder transfer system must be cleaned and maintained so that they can operate at peak efficiency. In conventional systems, maintenance is performed by periodically opening the sieve to atmosphere and suctioning or otherwise removing contaminants, debris or large powder particles therefrom in preparation for continued operation. Unfortunately, when the sieve is opened, all of the powder coating material downstream from the sieve, i.e., between the sieve and the powder spray guns, is subject to contamination from the atmosphere, service personnel and from the materials collected within the sieve. This is unacceptable in many coating operations, such as the application of coatings to vehicle bodies and the like, wherein the finished coating must be of extremely high quality.

SUMMARY OF THE INVENTION

It is therefore among the objectives of this invention to provide a powder delivery system including a powder supply hopper, a sieve and transfer devices for transmitting powder coating material discharged from the sieve to powder spray guns, which substantially prevents contamination of the powder coating material downstream from the sieve.

These objectives are accomplished in an apparatus which comprises an anti-contamination valve interposed between the discharge outlet of a sieve in a powder transfer system and the inlet to a powder feeder device communicating with one or more spray guns associated with a powder spray booth. The valve is movable between an open position in which powder discharged from the sieve is permitted to flow unobstructed to the powder feeder device, and a closed position which effectively seals or isolates that portion of the powder delivery system downstream from the sieve.

In the presently preferred embodiment, the anti-contamination valve of this invention comprises a valve body having an interior including an inlet connected to the outlet of the sieve, and an outlet connected to a powder feeder device. A disc is mounted on a shaft within the valve interior and is pivotal between an open position in which powder coating material is readily allowed to pass through the valve interior, and a closed position in which the peripheral edge of the disc is located proximate an internal wall within the valve interior. An annular rubber seal is carried in the valve wall in position to align with the peripheral edge of the disc. The rubber seal is inflatable with pressurized air, and, in the inflated condition, sealingly engages the peripheral edge of the disc. The use of an inflatable seal allows for precise control of the contact pressure with the disc to eliminate or at least substantially reduce agglomeration along the circumference of the disc.

When it is desired to perform maintenance on the sieve or otherwise expose the upstream portion of the powder delivery system to atmosphere, the disc is pivoted to the closed position, the annular rubber seal is inflated to sealingly engage the peripheral edge of the disc, and, vacuum is established to capture any particles stopped by the disc. The maintenance procedure can then be performed on the sieve, and any debris or other materials therefrom fall by gravity atop the closed disc and inflated rubber seal. While the maintenance operation on the sieve is underway, the debris is suctioned from the surface of the disc and rubber seal, or any other locations within the interior of the valve body, through a cleaning port extending into the valve interior. After the sieve is closed to atmosphere and the cleaning operation within the valve body is completed, the rubber seal is deflated, the disc is returned to its open position and the cleaning port is closed in preparation for normal coating operations.

This invention therefore provides a means of isolating the powder coating material within the powder delivery system which is located downstream from the sieve, to prevent any contamination thereof during sieve maintenance. The isolation or anti-contamination valve of this invention is easily installed between the sieve and powder feeder device, and provides no obstruction to the flow of powder therebetween during a normal coating operation.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
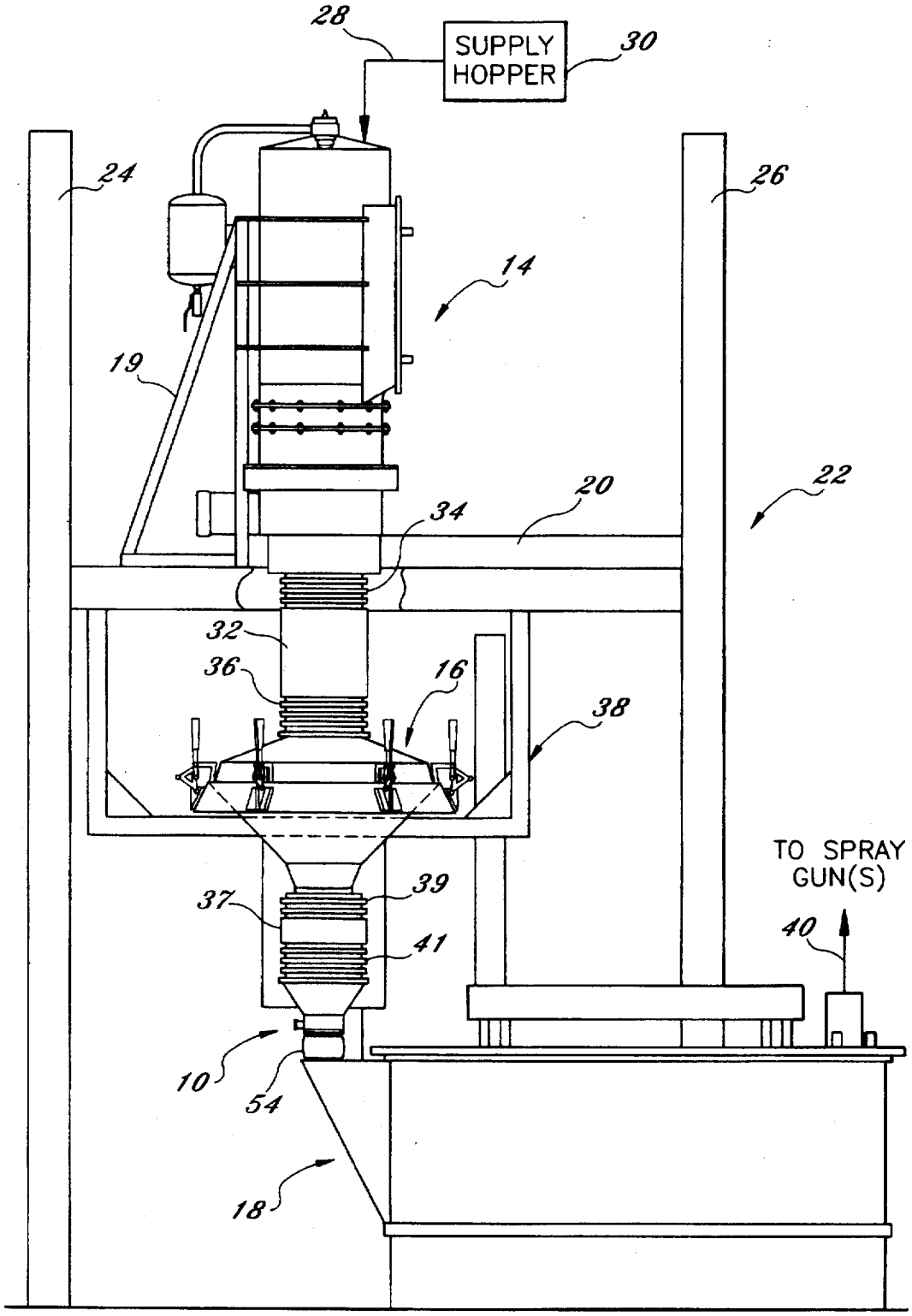
FIG. 1 is a schematic view of a portion of one type of powder delivery system incorporating the isolation valve of this invention.

Referring initially to FIG. 1, the anti-contamination or isolation valve 10 of this invention is illustrated in position within a powder delivery system 12 which includes a powder receiver unit 14, a sieve 16 and a primary hopper 18. For purposes of illustration, the powder receiver unit 14 is shown mounted by a bracket 19 atop a cross brace 20 of a support frame 22 having vertical legs 24, 26. The powder receiver unit 14 is connected by a line 28 to a supply hopper 30 containing virgin coating material. Preferably, the powder receiver unit 14 is of the type fully disclosed in U.S. patent application Ser. No. 08/320,921 to Shutic et al., filed Oct. 11, 1994, the disclosure of which is incorporated by reference in its entirety herein. The structural details of powder receiver unit 14 form no part of this invention, and are therefore not discussed in detail herein.

The powder receiver unit 14 discharges powder coating material through a sleeve 32 having flexible end portions 34, 36. The end portion 34 of sleeve 32 is connected to the inlet of sieve 16 which is carried within a hanger 38 mounted to the cross brace 20 of support frame 22. A sieve 16, suitable for purposes of the powder delivery system 12, is sold by Nordson Corporation of Amherst, Ohio, under Part No. 287,494. The details of the construction of sieve 16 form no part of this invention and are therefore not discussed herein.

Powder coating material discharged from the sieve 16 passes through a second sleeve 37 having a flexible end portion 39 connected to the sieve 16 and a flexible end portion 41 connected to the inlet of the valve 10 whose structure is described in detail below. The powder discharged from valve 10 enters primary hopper 18 which is connected by a line 40 to one or more spray guns associated with a powder spray booth (not shown). Preferably, the primary hopper 18 is of a type such as disclosed in Ser. No. 08/320,921 noted above, or a similar commercially available hopper device.

Referring now to FIGS. 2–5, the structure and operation of valve 10 is shown in detail. In the presently preferred embodiment, the valve 10 comprises a valve body 42 having a hollow interior 44 defining an internal wall 46. A flanged inlet adapter 48 is mounted by bolts 50 to one side of valve body 42, and a flanged outlet adapter 52 is mounted by bolts 50 to the opposite side of valve body 42. The inlet adapter 48 is connected to the end portion 41 of sleeve 37, and the outlet adapter 52 is connected to an inlet 54 of the primary hopper 18. In the open position, as discussed below, the valve 10 therefore provides a flow path for powder coating material from the sieve 16 into the primary hopper 18.

In the presently preferred embodiment, a circular disc 56 is mounted by screws 58 to a mounting block 60 located within the interior 44 of valve body 42. The mounting block 60 is connected by a set screw 62 at one end of a shaft 64 whose opposite end extends exteriorly of the valve body 42 and mounts a handle 66. See FIG. 5. As described below in connection with a discussion of the operation of valve 10, the shaft 64 is rotatable within a bearing (not shown) carried within a bearing mount 65 to pivot the disc 56 between a closed position depicted in FIGS. 2 and 4, and an open position depicted in FIG. 3.

In the presently preferred embodiment, the internal wall 46 of valve body 42 is formed with a recess 68 which mounts an annular shaped, inflatable seal 70 formed of rubber or a similar resilient material. The annular seal 70 is formed with a stem 72 which extends toward the exterior of the valve body 42, within a bore 73, where it connects to an air line 74 leading to a source of pressurized air 76, depicted schematically in the Figs.

Figure 2:
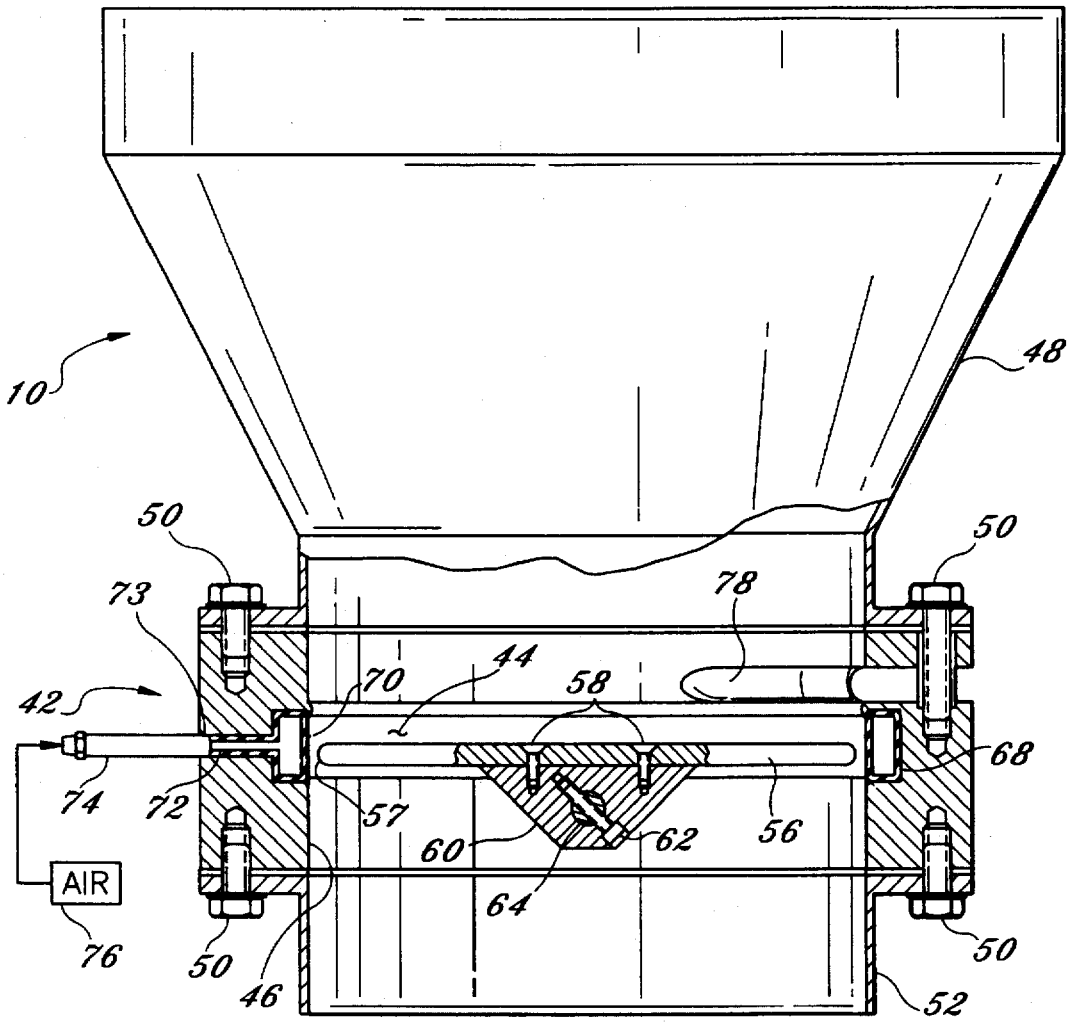
FIG. 2 is a elevational view in partial cross-section of the anti-contamination valve herein in a closed, but unsealed, position.
Figure 4:
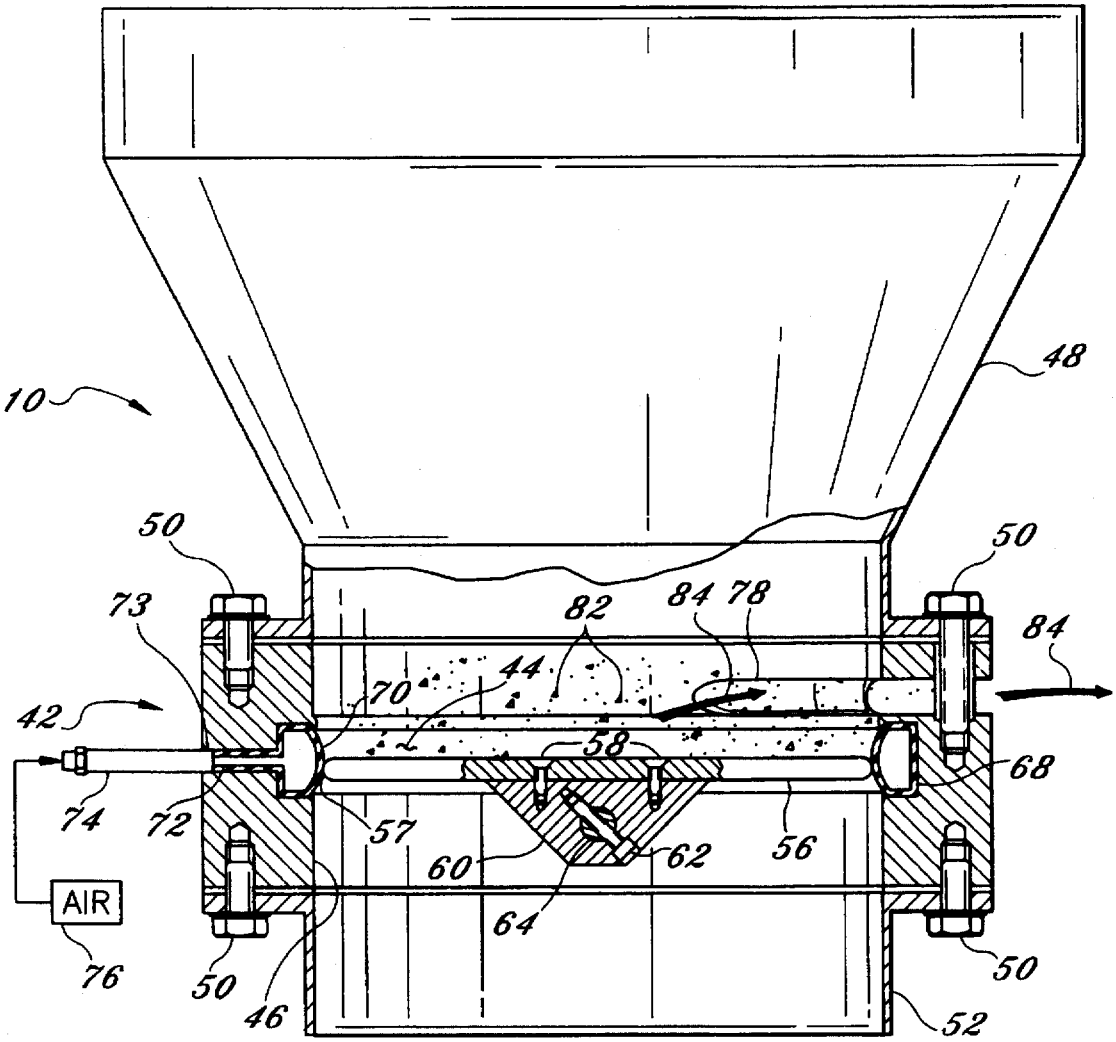
FIG. 4 is a view similar to FIG. 2 except with the valve disc in a closed and sealed position.
Figure 5:
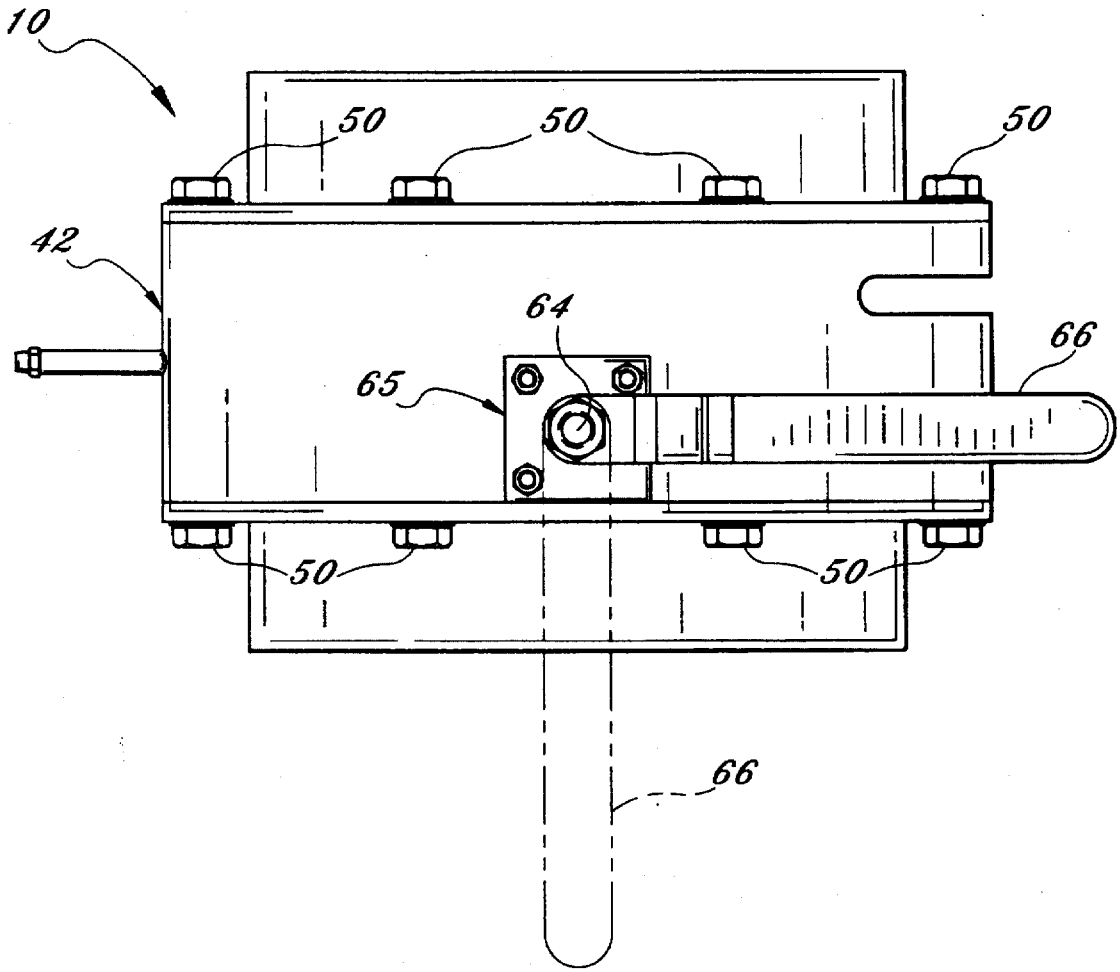
FIG. 5 is a side view of the valve herein illustrating the lever for opening and closing the valve.

As best shown in FIGS. 2 and 4, the annular seal 70 is located within recess 68 along the internal wall 46 of valve body 42 in position to align with the peripheral edge 57 of disc 56 with the disc 56 in a closed position, as discussed below. When filled with pressurized air from source 76, the annular seal 70 expands radially inwardly from the recess 68 toward the center of valve body interior 44 and into engagement with the peripheral edge 57 of disc 56 to create a seal therebetween. As shown in FIG. 4, with the disc 56 in a closed position and the annular seal 70 inflated, the disc 56 is located vertically below a cleaning port 78 extending through the valve body 42.

The operation of the powder delivery system 12 and isolation valve 10 are as follows. Initially, virgin powder coating material is withdrawn from the supply hopper 30 via line 28 into the powder receiver unit 14. As discussed in detail in application Ser. No. 08/320,921, a negative pressure is created within the interior of powder receiver unit 14 to draw or suction the virgin powder coating material from supply hopper 30 into the powder receiver unit 14. The powder coating material is allowed to fall by gravity from the powder receiver unit 14 through sleeve 32 into the sieve 16. The sieve 16 functions to remove debris, contaminants, and particles of the powder coating material which are larger than desired from the air-entrained powder coating material, thus allowing the remaining virgin powder coating material to pass into the valve 10. Under normal operation conditions, when a flow of powder is desired to the spray guns, the shaft 64 is rotated by handle 66 to pivot the disc 56 to an open position wherein it is substantially vertical and parallel to the internal wall 46 of valve body 42. See FIG. 3. As shown, with the valve 10 open, powder coating material 80 is allowed to fall by gravity, and/or under the influence of a negative pressure, into the primary hopper 18 from where it is supplied to one or more spray guns as discussed in Ser. No. 08/320,921. The valve 10 is maintained in this open position throughout normal operating conditions.

From time to time, routine maintenance must be performed on the sieve 16 in order to clear away the debris, contaminants, and larger powder particles collected thereon. The valve 10 of this invention provides a means to allow for maintenance of the sieve 16 while maintaining the virgin powder coating material located downstream therefrom substantially isolated, i.e., within primary hopper 18, the line 40, and any other powder feeder devices and lines leading to the spray guns associated with a powder spray booth.

Before performing such maintenance operation on the sieve 16, the shaft 64 is rotated by handle 66 to position the disc 56 in a substantially horizontal, closed position wherein its peripheral edge 57 is aligned with the inflatable seal 70 in the recess 68 of the valve body 42. With the disc 56 in this closed position, pressurized air from source 76 is transmitted through air line 74 and stem 72 into the interior of annular seal 70. This causes the seal 70 to expand radially inwardly from the recess 68, toward the interior 44 of valve body 42, and into engagement with the peripheral edge 57 of disc 56. As a result, a seal is created within the interior 44 of valve body 42 which isolates that portion of the powder delivery system 12 downstream from the outlet adapter 52 of valve 10 from the sieve 16. The degree of expansion of the annular seal 70, and, hence, the contact pressure it exerts against the peripheral edge 57 of disc 56, can be precisely controlled by varying the pressure of the air introduced into the seal 70. By controlling such contact pressure, agglomeration of powder material along the peripheral edge 57 of disc 56 is eliminated or at least substantially reduced.

Figure 3:
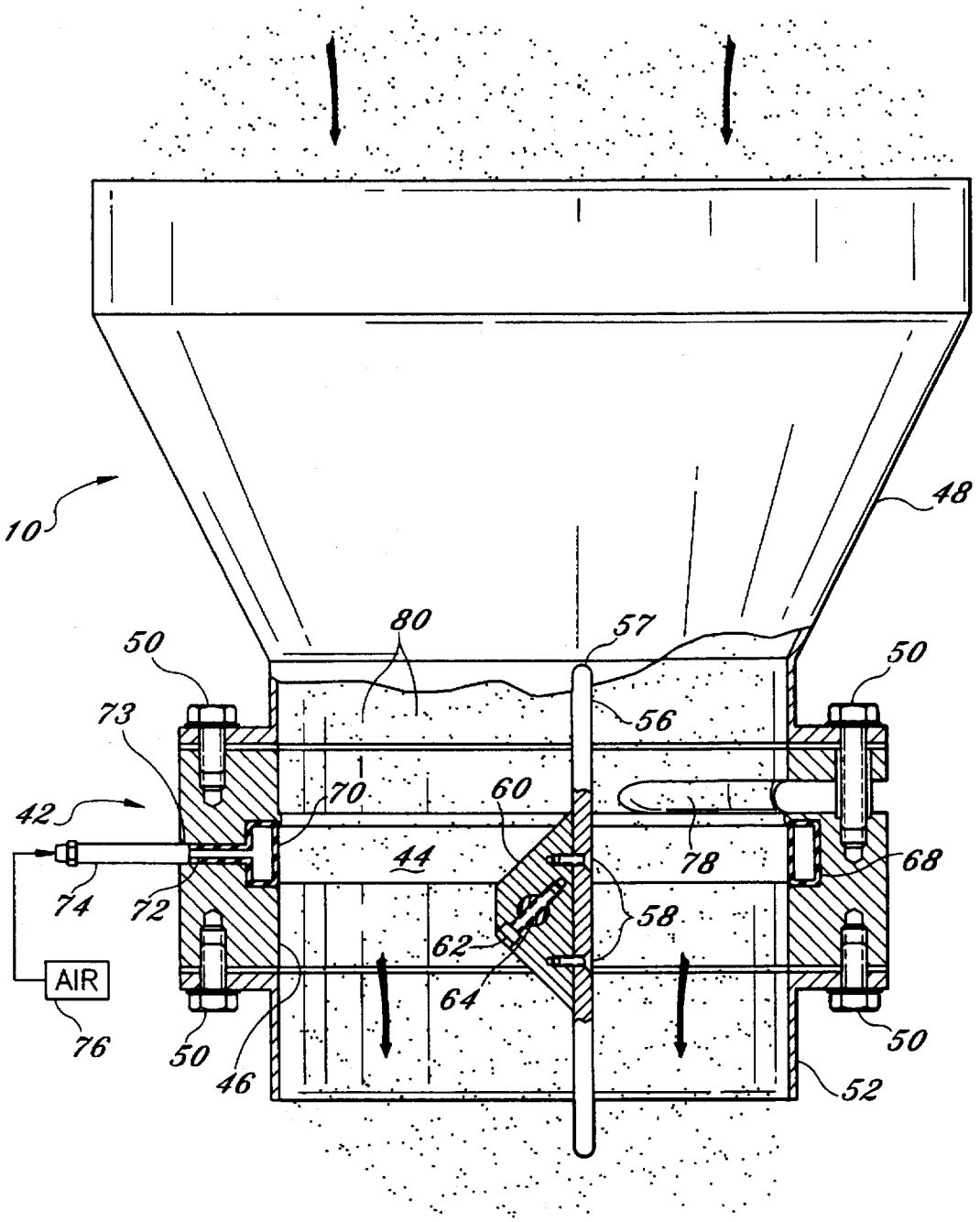
FIG. 3 is a side view of the valve depicted in FIG. 2 illustrating the disc in an open position.

With the valve 10 closed and sealed in the manner described above, routine maintenance can be performed on the sieve 16 and any debris or other contaminants which are dislodged therefrom during maintenance can fall by gravity atop the valve disc 56. After completion of the sieve maintenance is underway, the debris or contaminants 82 resting atop the disc 56 of valve 10 are removed by applying a suction through the cleaning port 78 of valve body 42, as schematically depicted by arrows 84 in FIG. 4. The entire interior 44 of valve body 42 upstream from disc 56 is thus cleaned and free of contaminants. When the sieve 16 is closed and the maintenance completed, the pressurized air within inflatable seal 70 is then exhausted, allowing the inflatable seal 70 to deflate and move radially outwardly into the recess 68, flush with the internal wall 46 of valve body 42, as shown in FIGS. 2 and 3. The shaft 64 is then rotated by handle 66 to pivot disc 56 back to the open position depicted in FIG. 3, in preparation for the resumption of the supply of powder coating material to the primary hopper 18.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the anti-contamination or isolation valve 10 of this invention is illustrated in a powder delivery system 12 of the general type disclosed in patent application Ser. No. 08/320,921. It should be understood, however, that the isolation valve 10 is useful in other types of systems employing a sieve which may or may not include intermediate hoppers or powder feeder devices located between the sieve and powder spray guns associated with a powder spray booth. See, for example, U.S. Pat. No. 5,078,084 owned by the assignee of this invention.

Therefore, it is intended that the invention not be limited to the particular embodiment disclosed as the best mode contemplated for carrying out the invention, but that the invention will include all embodiments falling within the scope of the appended claims.

What is claimed is:

1. A system for delivering powder coating material, comprising:

a source of virgin powder coating material;

a sieve having an inlet communicating with said source, and an outlet;

a powder transfer device having an inlet for receiving powder coating material, and an outlet adapted to communicate with at least one powder spray gun;

a valve connected between said outlet of said sieve and said inlet of said powder transfer device, said valve comprising:

(i) a valve body having an interior including an inlet adapted to communicate with a source of powder coating material, and an outlet adapted to communicate with at least one powder spray gun;

(ii) a closure member carried within said interior of said valve body between said inlet and said outlet, said closure member being movable between an open position and a closed position;

(iii) a sealing member mounted to one of said valve body and said closure member, said sealing member being effective to create a seal between said closure member and said valve body in said closed position of said closure member to substantially isolate said inlet of said valve body from said outlet thereof; and said valve, with said closure member in said closed position, being effective to isolate said sieve from powder coating material within said powder transfer device and downstream therefrom to avoid contamination of such powder coating material during cleaning of said sieve.

2. The system of claim 1 in which said valve body is formed with a cleaning port extending into said interior at a position between said inlet to said valve body and said closure member, said cleaning port being effective to permit the application of a vacuum within said valve interior to remove debris and contaminants deposited from said sieve onto said closure member with said closure member and said sealing member sealingly engaged with one another.

3. The system of claim 1 in which said interior of said valve body forms a valve wall, said closure member comprising a disc pivotal within said interior of said valve body between said open and closed positions, said disc having a peripheral edge which is spaced from said valve wall in said closed position thereof.

4. The system of claim 3 in which said sealing member is an inflatable seal carried by said valve wall of said valve body, said inflatable seal being expandable when inflated to sealingly engage said peripheral edge of said disc.

5. The system of claim 4 in which said inflatable seal is an annular-shaped rubber seal having an inlet/exhaust port connectable to a source of pressurized air.

6. The system of claim 3 in which said disc is mounted on a shaft extending into said interior of said valve body, said shaft being rotatable to pivot said disc between said open and closed positions.

* * * * *